US006443163B1

(12) United States Patent
Merges

(10) Patent No.: US 6,443,163 B1
(45) Date of Patent: Sep. 3, 2002

(54) HAIR CURLER FOR WINDING UP HUMAN HAIR

(75) Inventor: Heinz Merges, Cologne (DE)

(73) Assignee: Juenemann GmbH, Kassel (DE)

( * ) Notice: Subject to any disclaimer, the term of this patent is extended or adjusted under 35 U.S.C. 154(b) by 0 days.

(21) Appl. No.: 09/808,432

(22) Filed: Mar. 14, 2001

(51) Int. Cl.[7] ..... A45D 2/14; A45D 6/16; A45D 2/08

(52) U.S. Cl. ..... 132/262; 132/252; 132/250

(58) Field of Search ..... 132/262, 252, 132/222, 268, 253, 207, 250, 254, 260, 267, 255, 249

(56) References Cited

U.S. PATENT DOCUMENTS

| | | | | | |
|---|---|---|---|---|---|
| 2,630,127 | A | * | 3/1953 | Isbell | 132/262 |
| 3,050,070 | A | * | 8/1962 | Sidelman | 132/262 |
| 3,533,418 | A | | 10/1970 | De Mestral | 132/40 |
| 3,688,778 | A | * | 9/1972 | Budman et al. | 132/253 |
| 3,812,866 | A | * | 5/1974 | Morane | 132/255 |
| 4,605,021 | A | * | 8/1986 | Hodson | 132/249 |
| 5,165,429 | A | * | 11/1992 | Miller | 132/255 |
| 5,626,156 | A | * | 5/1997 | Vicory | 132/250 |
| 5,692,528 | A | * | 12/1997 | Breen-Albertoni | 132/262 |
| 5,832,939 | A | * | 11/1998 | Nathe | 132/225 |
| 6,026,826 | A | * | 2/2000 | Hall et al. | 132/222 |
| 6,119,703 | A | * | 9/2000 | Santhouse et al. | 132/262 |

FOREIGN PATENT DOCUMENTS

| | | | |
|---|---|---|---|
| EP | 00 10 8712 | 12/2001 | A45D/2/24 |
| FR | 1.300.337 | 6/1961 | |
| FR | 1.364.926 | 7/1963 | |
| FR | 2.104.573 | 3/1972 | |

* cited by examiner

*Primary Examiner*—John J. Wilson
*Assistant Examiner*—Robyn Kieu Doan
(74) *Attorney, Agent, or Firm*—James W. Kayden; Thomas, Kayden, Horstemeyer & Risley, LLP

(57) ABSTRACT

A hair curler (1) for waving hair includes a hollow supporting body (2). The cross section diminishes from the first end (3) over the axial length towards the second end (4). An enlarged element (6) has a cross section being more than the cross section of the second end (4), it is located in the region of the second end (4) and it is designed and arranged to prevent hair from slipping off the hair curler (1). A fixing device (8) is designed and arranged to fix the supporting body (2) in the region of the base of the hair. A hook band (7) is located on the circumference of the supporting body (2). The hook band (7) at least covers a portion of the circumference of the supporting body (2). The portion approximately extends from the region of the first end (3) in the direction of the axial length of the supporting body (2). The supporting body (2) at least in the portion being covered by the hook band (7) has an approximately oval cross section.

23 Claims, 1 Drawing Sheet

HAIR CURLER FOR WINDING UP HUMAN HAIR

FIELD OF THE INVENTION

The present invention generally relates to a hair curler for winding up human hair to create curls. More particularly, the present invention relates to a hair curler including a body the diameter of which diminishes from its first end over its axial length towards its second end. Such hair curlers are used to wind up or to wave tresses of hair to form curls. The novel hair curler may be used for fast hairstyles as well as for the production of permanent waves.

BACKGROUND OF THE INVENTION

A hair curler is known from German patent document No. 30 05 837. The known hair curler includes a conical supporting body being made of plastic or metal. The supporting body at its end having a smaller diameter includes an enlarged rim portion. At this place, a needle is used as a fixing device. With the known hair curler, is desired to form the hair to have a natural waveform after the hair curler has been unwound. The change of the cross section over the axial length is discontinuous. The tress of hair to be wound up is hard to be fixed on the circumference of the supporting body. The fixing device in the form of the needle also fixes the curl on the supporting body.

Another hair curler is known from German utility model No. 1 851 303. The known hair curler includes a supporting body being made of injection-molded plastic or of metal. The supporting body determines the shape of the hair curler and it only has limited flexibility. A knitted or woven wide-meshed pad-like coating is located on the surface of the supporting body. The coating may have a plush-like surface. Due to the wide-meshed design, it is possible to insert an insertion needle through the coating and through the supporting body in a transverse direction after the winding process of the tress of hair has been finished. The insertion takes place without damaging the coating or the supporting body. The insertion needle also fulfills the function of a fixing device for the hair curler with respect to the head. Due to the wide-meshed plush-like coating, the tress of hair to be wound up is gently supported on the circumference of the hair curler without bending effects. However, there is the danger of the friction between the hair and the coating not being sufficient during the winding process. Consequently, the winding up process requires substantial skills, especially in case a fixed, tight connection is to be achieved between the curl and the hair curler. The insertion needle to be inserted in a transverse direction also serves to fix the curl on the circumference of the hair curler.

A friction winding device for winding up human hair is known from German patent No. 40 18 202 C2. The friction winding device includes a friction body having outwardly protruding friction protrusions being arranged in a way similar to the hook band of a Velcro fastener. The friction protrusions frictionally engage the hair directly. Such friction winding devices have the advantage of no fixing device of any kind being necessary. The tress of hair to be wound up on the circumference directly engages and contacts the hooks of the hook band. The curl is fixed on the circumference of the coating already during the winding process. After the winding process has been finished, the friction winding device automatically achieves a fixed connection with respect to the head. Consequently, no fixing device, for example a clasp, a transverse locking device or the like, has to be operated. The supporting body may be a cylindrical portion being made of foamed plastic having such a narrow pore design that it is capable of absorbing fluids. The unit consisting of the supporting body and the friction body has a soft and elastic design.

The known hair curlers and the known friction winding devices have the disadvantage of the wound up tress of hair—starting at the tips of the hair and ending at the base of the hair at the scalp—building up on the hair curler during the winding process. This means that a first portion of the tress of hair is wound up on the hair curler during a first rotation of the hair curler and a second portion of the tress of hair following the first portion is wound up on the first portion during a second rotation of the hair curler. Consequently, the tress of hair is wound up on the hair curler and on the already wound up portion of the tress of hair, respectively, to build up on the hair curler with an increasing bending radius. Additionally, the use of a separate fixing device for fixing the hair curler and the wound up tress of hair at the head is necessary. The fixing device may be a needle or a pin. Depending on the skills of the user, the end of the tress of hair adjacent the scalp remains in a more or less unwound state. However, it extends straight from the scalp to the tangential winding point being located at the circumference of the cylindrical supporting body.

SUMMARY OF THE INVENTION

The present invention relates to a hair curler for winding up human hair. The hair curler includes a hollow supporting body having a first end, a second end, an axial length, a circumference and a cross section. The cross section diminishes from the first end over the axial length towards the second end. An enlarged element has a cross section being more than the cross section of the second end, it is located in the region of the second end and it is designed and arranged to prevent hair from slipping off the hair curler in a mounted position of the hair curler. A fixing device is designed and arranged to fix the supporting body in the region of the base of the hair in the mounted position of said the curler. A hook band is located on the circumference of the supporting body. The hook band at least covers a portion of the circumference of the supporting body. The portion approximately extends from the region of the first end in the direction of the axial length of the supporting body. The supporting body at least in the portion being covered by the hook band has an approximately oval cross section. It is to be understood that the fixing device may be a separate element or the hook band may fulfil its function.

The present invention is based on the concept of designing the hair curler to have a cross-section diminishing from its one end towards its other end and in a way that it has an elliptical or oval cross section at least at its starting end. Special effects may be achieved by the supporting body at least in the region being covered by the portion of the hook band at the starting end of the supporting body having an oval cross section. The oval cross section realizes the deformation of the tress of hair and the design of the curl, respectively, in the region adjacent to the tips of the hair. In this way, greater radiuses and smaller radiuses are alternately realized over the length of the tress of hair. Corresponding to the generally diminishing cross section, the radiuses have different extensions in the direction towards the scalp. In case the supporting body in its second portion facing its cone-like tip has a circular cross section, the above-mentioned difference is not present in this second portion. However, this fact does not have a negative effect since it is important to create a tight, curly volume of hair in this portion close to the scalp to provide great stability and durability of the hairstyle. In this way, it is possible to wind up the tress of hair starting with the tips of the hair at the first or starting end of the hair curler, meaning the end having a greater cross section. The separate threads of the tress of hair are not curled up one above the other, as it is known in the art, but rather in a displaced manner in an axial direction of the hair curler towards the tip and the second end having a smaller cross section. Thus, a curl in the region of the tips having a greater bending radius and having a smaller bending radius adjacent to the scalp is produced. The smaller bending radius being located in the region of the base of the hair and of the scalp, respectively, is very important for the looks of the curl and of the resulting hairstyle, respectively. The comparatively smaller bending radius provides for a greater density of the hairstyle close to the head. The curl is bent in the region of the tips of the hair different from what known cylindrical or conical hair curlers produce. The tendency of the bending radiuses of the curls being produced with the novel hair curler is opposite to what is known in the prior art. This results in a novel esthetical impression of the hairstyles being attained with the curls being made with the novel curler. The diminishing cross section of the hair curler and the bending radiuses of the curls changing from the tips in a direction towards the scalp have another advantage of the straight pieces of hair of the tress of hair being located directly adjacent to the scalp being reduced. The novel curler allows for producing curls and a hairstyle, as it was not possible in the prior art. The novel hairstyle in the region close to the head has a great volume and a very curly design providing great stability. In the region of the tips of the hair, the curls have a comparatively greater bending radius.

There are a number of different possibilities of realizing and designing the fixing device. The fixing device may include a portion of a hook band being located on the circumference of the supporting body. In this case, the hook band not only forms the supporting location for the tress of hair to be wound up to form a curl, but it also forms the fixing device. In this way the use of a separate fixing device in the form of a needle, a pin or the like is not necessary. The design of the hook band including protruding elements having bent or enlarged ends is sufficient to securely fix the hair curler close to the scalp at the end of the winding process. In case of the supporting body in the region of its second end having a very small cross-section and, consequently, a very small radius, the arrangement of the hook band at this place may have a negative effect in a way that the hair curler is fixed to the scalp too much. This may have a negative effect on the unwinding process. On the other hand, a very small bending radius in the region of the second end of the hair curler is especially desired to vary the bending radius within a great range, meaning to cover great diameters changes of the supporting body. In this case, it makes sense to design the hook band to cover the thicker first end of the supporting body and to only cover a part of the length of the supporting body and to additionally use a separate fixing needle, a pin or the like as the fixing device. In such an embodiment of the novel hair curler, the portion of the hook band serves to anchor the tips of the hair at the hair curler. Thus, the beginning of the winding process is simplified. It is no longer necessary to wind up the tips of the hair for some rotations in a way to build up, but instead, the axial displacement of the tress of the hair may start right at the beginning of the winding process and directly adjacent to the tips of the hair. The portion of the hook band extends over approximately half the length of the hair curler. The hook band does not cover the thinner second end of the hair curler. This design of the novel hair curler requires the use of an additional separate fixing device, for example a needle, a pin or a plug. Preferably, the plug is being inserted through the supporting body in the region of the second end of the hair curler in a transverse direction with respect to the axial direction. For this purpose, the supporting body at least in this region has a partly opened design.

The supporting body at is thicker starting first end may have an oval cross section changing to a circular cross section. The supporting body imparts the hair curler a characteristic shape in the form of a more or less acute cone or a truncated cone. The supporting body may also include circular portions. However, the circular or oval cross sections are of special importance to the invention. The course of the cross section varies over the axial length of the hair curler.

It is important to prevent the wound up tress of hair from sliding off the second end of the supporting body having the smaller diameter. For this purpose, an enlarged element, a protrusion or a different member is located at the second end of the supporting body. Especially, the enlarged element being located at the second end of the supporting body may have a spherical design. On the one hand, such a spherical design prevents the wound up tress of hair from sliding off this end and, on the other hand, it makes it possible to easily grasp, hold and turn the hair curler during the curling process.

The surface of the supporting body may have a partially opened design to make it possible to insert the fixing needle through the supporting body. The openings may be arranged only in a part of the length of the hair curler, or they may be arranged over the entire length of the hair curler. The openings provide better aeration of the wound up curl, for example during a drying process by means of a hair dryer.

The novel hair curler may be used for fast hairstyles with or without humidifying the hair, and also for the production of permanent waves. The supporting body may include a connecting element for temporarily connecting a hairdryer to the hair curler. The connecting element is located in the region of the first end of the supporting body, meaning in the region having a comparatively greater cross section.

As it has already been explained, the fixing device may be realized in very different ways. Another possibility is to design the fixing device to include a strip of coating band. After the winding process of the tress of hair has been finished, such a strip may be put on the wound up tress of hair approximately in the longitudinal direction or in a slightly screw-type manner. The use of a strip of coating band requires the use of the hook band being located on the surface of the supporting body. The fixing effect is realized by the coating band engaging the hook band and cooperating therewith. This cooperation is possible since the tress of hair is not wound up to build one roll, but instead the threads of the tress of hair are located one beside the side the other.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
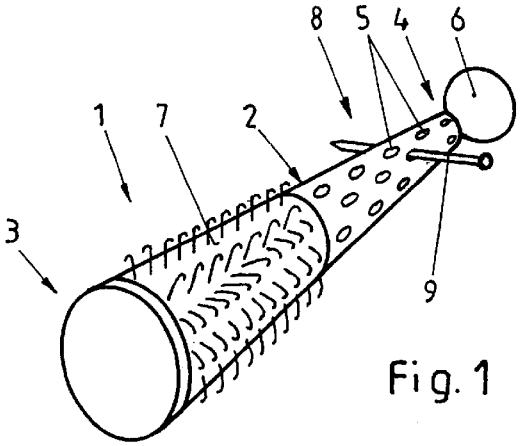
FIG. 1 is a perspective view of a first exemplary embodiment of the hair curler.

Referring now in greater detail to the drawings, FIG. 1 illustrates a hair curler 1 including a supporting body 2. The supporting body 2 has an approximately conical design and a design of a truncated cone, respectively. A conical design and a design of a truncated cone are not to be understood as being exactly conical but rather as designs in which the cross section diminishes from one end to the other end. The hair curler 1 and the supporting body 2, respectively, extends from a first end 3 to its other second end 4 over its axial length. The first end 3 or the starting end is to be understood as the end having a comparatively greater cross section. As it is already to be seen from FIG. 1, the supporting body 2 and the hair curler 1 at their starting end have an oval cross section of a comparatively great diameter. The diameter diminishes in the direction towards the other second end 4. The supporting body 2 may especially be designed as a hollow body. It may be made of plastic or of metal and, usually, it has sufficient form stability and stiffness. The supporting body 2 may be open-worked over its axial length in the form of a grid or of a grate or it may include a number of approximately circular openings 5. The supporting body 2 and the hair curler 1, respectively, in the region of its other end 4 includes an enlarged element 6. In this embodiment, the enlarged element 6 has the shape of an approximately spherical protrusion. The enlarged element 6 may form one piece with the supporting body 2. The supporting body 2 and the enlarged element 6 may be made by injection molding. It is important that the enlarged element 6 has a greater diameter than the supporting body 2 in the region of the second end 4. The enlarged element 6 fulfills two functions. First, it prevents hair from slipping off the hair curler 1 during and after the winding process. Second, the hair curl 1 may be easily grasped and operated at the enlarged element 6. This is especially helpful while the hair is being wound up.

A portion of a hook band 7 is located at the outer circumference of the supporting body 2. Especially, the hook band 7 extends from the first end 3 over a certain axial length of the supporting body 2. The hook band 7 is connected to the supporting body 2. The hook band 7 has a known design being similar to the design of Velcro fastener. The hook band 7 includes a number of separate hooks or spikes extending in an approximately radial direction. The hooks have a somewhat bent design and the spikes have enlarged ends. In the exemplary embodiment of the hair curler illustrated in FIG. 1, the strip of hook band 7 covers approximately half of the axial length of the hair curler 1 and of the supporting body 2, respectively. However, it is also possible that the hook band 7 has a shorter design or a longer design to cover less or more than half of the length of the supporting body 2. Especially in case the difference between the diameters of the first end 3 and of the second end 4 is less, meaning that the supporting body 2 approximately has the shape of a truncated cone, the hook band 7 may extend over the entire length of the supporting body 2. However, the hook band 7 does not cover the enlarged element 6.

The hair curler 1 further includes a fixing device 8. In the embodiment illustrated in FIG. 1, the fixing device 8 has the design of a needle 9. After the winding process of the strand or of the tress of hair has been finished, the needle 9 may be inserted through openings 5 of the supporting body 2 in a transverse direction.

The novel hair curler 1 may be operated and used as follows:

A tress of hair is taken from the head 10 in a known way, and the tips of the hair 11 are put on the circumference of the hook band 7 in the region of the first end 3. In this way, the tips of the hair 11 are inserted between the hooks of the hook band 7, and at least after partly covering the circumference of the supporting body 2 and of the hook band 7, respectively, they are fixedly connected to the hair curler 1. Next, the winding process is continued by a relative rotation of the hair curler 1 with respect to the tress of hair. Contrary to a known winding process in case of a known cylindrical hair curler, the tress of hair is wound up on the supporting body 2 in a thread-like manner. In this way, the separate threads of hair are located at a certain distance with respect to one another in a way that the entire surface of the supporting body 2 and of the hair curler 1, respectively, is used from the first end 3 to the second end 4. It is to be understood that the tress of hair is wound up on a diameter that continuously diminishes. Thus, the tress of hair has a bending radius that diminishes continuously. The winding process ends when the tress of hair reaches the second end 4, on the one hand, and the scalp 12 (FIG. 2), on the other hand. It is not necessary to reach the region of the enlarged element 6. It is also possible to stop the winding process earlier when the scalp 12 has been reached and when the winding process cannot be continued. However, when a person uses the novel hair curler 1, the person quickly attains the skill of cooperating the ending of the winding process with the act of reaching the second end 4 and the scalp 12, respectively. In this way, the hair curler 1 is located very close to the scalp 12 and to the head 10, respectively. After the rotating movement of the hair curler 1 has been finished, the fixing device 12 is used by inserting the needle 9 into the openings 5 in a transverse direction, as this is illustrated in FIG. 1.

Figure 2:
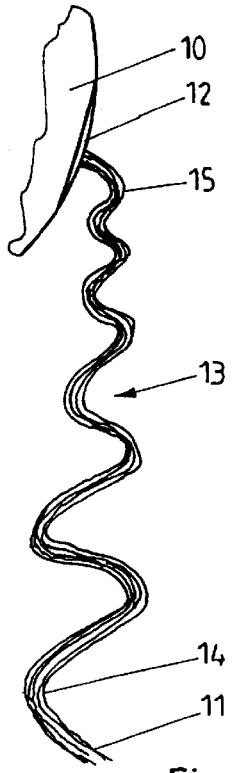
FIG. 2 is a view of a curl that may be produced with the hair curler.

After the unwinding process of the tress of hair, the tress of hair has the shape of a curl 13, as it is illustrated in FIG. 2. It is to be understood that the unwinding process takes place by a rotation in the opposite direction. The curl 13 in the region of the tips of the hair I 1 has a great bending radius 14 corresponding to the oval cross section, and in the region adjacent to the scalp 12 it has a comparatively smaller bending radius 15. In other words, the curl 13 in the region of the tips of the hair 11 has a rather loose and open design, whereas the hair adjacent to be scalp 12 has a rather strongly bent design providing greater stability. At the same time, such a hairstyle provides greater density in the region of the scalp 12 and improved volume since regions of the stress of hair are part of the curls that remain unbent in the prior art.

Figure 3:
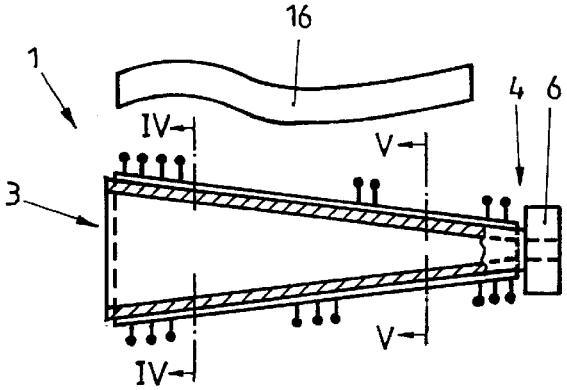
FIG. 3 is a sectional view through a second exemplary embodiment of the hair curler.
Figure 4:
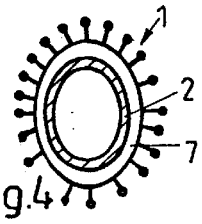
FIG. 4 is a view of a section along line IV—IV in FIG. 3.
Figure 5:
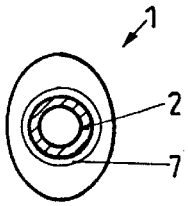
FIG. 5 is a view of a section along line V—V in FIG. 4.

FIGS. 3 to 5 illustrate another exemplary embodiment of the hair curler 1. The supporting body 2 has a design being similar to a truncated cone. The supporting body 2 ends in an enlarged element 6 having the design of a wide flange. The hook band 7 including protruding hooks extends from the first end 3 to the second end 4 of the supporting body 2 in a continuous manner. Instead of the needle 9 (FIG. 1), the fixing device 8 includes a portion of a coating band 16 either being provided in a loose manner or being connected to the inner wall of the supporting body 2 in way that it may always be used for fixing purposes after the winding process. After the winding process has been finished, the strip of coating band 16 is pressed onto the circumference of the hook band 7 being located on the supporting body 2 in a longitudinal direction or in a slightly transverse direction.

As it is to be seen from FIGS. 4 and 5, the supporting body 2 and thus the hair curler 1 has an oval or elliptical shape. In the region of the first end 3, it has an oval cross section (FIG. 4). Towards the second end 4, the oval cross section changes into a smaller circular cross section (FIG. 5). In this way, the bending radius in the region of the tips of the hair 11 differs from other regions of the curl 13. The bending radius in the region of the tips of the hair 11 approximately corresponds to half the diameter of the ellipse of the cross section. FIG. 2 illustrates the curl 13 having this tendency. On the other hand, the second end 4 of the supporting body 2 has a circular cross section to realize a very small bending radius adjacent to the scalp 12 and to improve the consistency of the curl 13 and of the hairstyle, respectively.

Figure 6:
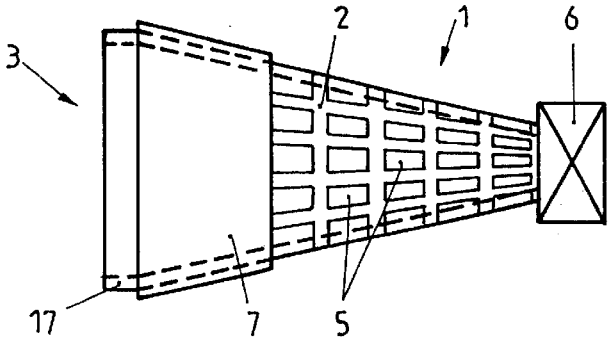
FIG. 6 is a view of another exemplary embodiment of the hair curler.

FIG. 6 illustrates another exemplary embodiment of the hair curler 1 having a generally similar design. The supporting body 2 ends in an enlarged element 6 having a square cross section. The portion of the hook band 7 only extends over approximately one third of the length of the supporting body 2. A connecting member 17 for a hairdryer, a heating element or the like is located at the first end 3 of the supporting body 2. With the connecting member 17, the hair curler 1 may also be wound up by means of a heating element. It is to be understood that the heating element is taken off the hair curler 1 after the winding process has been finished. The hair curler 1 also includes a fixing device 8 being similar to the one illustrated in FIG. 1.

Many variations and modifications may be made to the preferred embodiments of the invention without departing substantially from the spirit and principles of the invention. All such modifications and variations are intended to be included herein within the scope of the present invention, as defined by the following claims.

I claim:

1. A hair curler for winding up human hair, comprising:

a hollow supporting body having a first end, a second end, an axial length, a circumference and a cross section, the cross section diminishing from the first end over the axial length towards the second end;

an enlarged element having a cross section being more than the cross section of the second end, being located in the region of the second end and being designed and arranged to prevent hair from slipping off said hair curler in a mounted position of said hair curler;

a separate fixing device being removably attached and arranged to fix said supporting body in the region of the base of the hair in the mounted position of said hair curler; and a hook band being located on the circumference of said supporting body, said hook band at least covering a portion of the circumference of said supporting body, the portion approximately extending from the region of the first end in the direction of the axial length of said supporting body, said supporting body at least in the portion being covered by said hook band having an approximately oval cross section.

2. The hair curler of claim 1, wherein said hook band is designed and arranged to fulfill the function of said fixing device.

3. The hair curler of claim 1, wherein said hook band only covers a part of the axial length of said supporting body, the part beginning at the first end of said supporting body, and wherein said fixing device is designed as a fixing needle.

4. The hair curler of claim 1, wherein said supporting body has an approximately oval cross section in the region of the first end, and it has an approximately circular cross section in the region of the second end.

5. The hair curler of claim 1, wherein said enlarged element has a spherical design.

6. The hair curler of claim 1, wherein said supporting body includes a plurality of openings.

7. The hair curler of claim 3, wherein said supporting body includes a plurality of openings being designed and arranged for an insertion of said fixing needle.

8. The hair curler of claim 4, wherein said supporting body includes a plurality of openings.

9. The hair curler of claim 5, wherein said supporting body includes a plurality of openings.

10. The hair curler of claim 1, wherein said supporting body further includes a connecting element being designed and arranged to be connected to a hairdryer.

11. The hair curler of claim 10, wherein said fixing device includes a strip of coating band.

12. The hair curler of claim 3, wherein said supporting body includes a plurality of openings being exclusively arranged in the portion not being covered by said hook band.

13. A hair curler for winding up human hair, comprising:

a hollow supporting body having a first end, a second end, an axial length, a circumference and a cross section, the cross section diminishing from the first end over the axial length towards the second end;

an enlarged element having a cross section being more than the cross section of the second end, being located in the region of the second end and being designed and arranged to prevent hair from slipping off said hair curler in a mounted position of said hair curler;

a fixing device being designed as a fixing needle and being designed and arranged to fix said supporting body in the region of the base of the hair in the mounted position of said hair curler; and a hook band being located on the circumference of said supporting body, said hook band covering a portion of the circumference of said supporting body, the portion approximately extending from the region of the first end in the direction of the axial length of said supporting body, said supporting body at least in the portion being covered by said hook band having an approximately oval cross section.

14. The hair curler of claim 13, wherein said supporting body has an approximately oval cross section in the region of the first end, and it has an approximately circular cross section in the region of the second end.

15. The hair curler of claim 13, wherein said enlarged element has a spherical design.

16. The hair curler of claim 13, wherein said supporting body includes a plurality of openings.

17. The hair curler of claim 13, wherein said supporting body includes a plurality of openings being designed and arranged for an insertion of said fixing needle.

18. The hair curler of claim 14, wherein said supporting body includes a plurality of openings.

19. The hair curler of claim 15, wherein said supporting body includes a plurality of openings.

20. The hair curler of claim 13, wherein said supporting body further includes a connecting element being designed and arranged to be connected to a hairdryer.

21. The hair curler of claim 20, wherein said fixing device includes a strip of coating band.

22. The hair curler of claim 13, wherein said supporting body includes a plurality of openings being exclusively arranged in the portion not being covered by said hook band.

23. A device for waving human hair, comprising:

a body having a first end, a second end, an axial length, a circumference and a cross section, the cross section diminishing from the first end over the axial length towards the second end;

an enlarged element having a cross section being more than the cross section of the second end and being located in the region of the second end;

a fixing needle being designed and arranged to fix said supporting body in the region of the base of the hair in the mounted position of said hair device for waving human hair; and a hook band being located on the circumference of said body, said hook band covering a portion of the circumference of said body, the portion approximately extending from the region of the first end in the direction of the axial length of said body, said body at least in the portion being covered by said hook band having an approximately oval cross section.

* * * * *